US006790019B1

(12) United States Patent
Hinchey, Jr.

(10) Patent No.: US 6,790,019 B1
(45) Date of Patent: Sep. 14, 2004

(54) ROTARY VANE PUMP WITH MULTIPLE SOUND DAMPENED INLET PORTS

(75) Inventor: Ronald R. Hinchey, Jr., Harvey, LA (US)

(73) Assignee: Thomas Industries Inc., Sheboygan, WI (US)

( * ) Notice: Subject to any disclaimer, the term of this patent is extended or adjusted under 35 U.S.C. 154(b) by 0 days.

(21) Appl. No.: 10/608,668

(22) Filed: Jun. 27, 2003

Related U.S. Application Data

(60) Provisional application No. 60/451,366, filed on Feb. 28, 2003.

(51) Int. Cl.[7] ..... F04C 18/344; F04C 29/06
(52) U.S. Cl. ..... 418/15; 418/181
(58) Field of Search ..... 418/15, 181

(56) References Cited

U.S. PATENT DOCUMENTS

| | | | | |
|---|---|---|---|---|
| 2,048,218 A | | 7/1936 | Philipp | |
| 2,639,855 A | | 5/1953 | Daniels | |
| 4,286,933 A | | 9/1981 | Sakamaki et al. | |
| 4,544,337 A | | 10/1985 | Maruyama | |
| 4,580,949 A | | 4/1986 | Maruyama | |
| 4,747,761 A | * | 5/1988 | Yumiyama et al. | 418/181 |
| 5,017,098 A | | 5/1991 | Hansen et al. | |
| 5,466,135 A | | 11/1995 | Draskovits et al. | |
| 5,573,388 A | | 11/1996 | Tar et al. | |
| 6,024,547 A | | 2/2000 | Nagae | |
| 6,149,414 A | | 11/2000 | Abelen et al. | |

FOREIGN PATENT DOCUMENTS

| | | | | |
|---|---|---|---|---|
| DE | 3932299 | * | 4/1991 | 418/181 |
| RU | 731000 | * | 4/1980 | 418/181 |

* cited by examiner

*Primary Examiner*—John J. Vrablik
(74) *Attorney, Agent, or Firm*—Quarles & Brady LLP

(57) ABSTRACT

A rotary vane pump has an open ended pump cylinder mounting a drive motor at one end and a ported end plate and sound chamber at the other end. The cylinder contains a rotor mounted to an eccentric drive shaft and having vane grooves receiving slidable vanes contacting an inner diameter of the cylinder. The end plate has an outlet port and primary and secondary inlet ports in communication with the cylinder interior, the inlet ports being in communication with an area of net expansion. The sound chamber has an intake port and an exhaust port in communication with the respective outlet and primary and secondary inlet ports of the end plate. The sound chamber is partitioned to define a number of internal cavities through which the incoming air is routed to the secondary inlet port.

10 Claims, 2 Drawing Sheets

ROTARY VANE PUMP WITH MULTIPLE SOUND DAMPENED INLET PORTS

CROSS-REFERENCE TO RELATED APPLICATION

This application claims priority to Provisional Patent Application No. 60/451,366 filed Feb. 28, 2003.

STATEMENT OF FEDERALLY SPONSORED RESEARCH OR DEVELOPMENT

Not applicable.

BACKGROUND OF THE INVENTION

1. Technical Field

The present invention relates to pumps and in particular to sliding or rotary vane pressure or vacuum pumps.

2. Description of the Related Art

Rotary vane pumps, sometimes referred to as sliding vane pumps, are well known. Conventional rotary vane pumps include a drive motor with a rotatable shaft that mounts a rotor eccentrically inside of a cylindrical housing. The rotor has a number of slots (for example four or more) opening at its circumference and extending into the rotor radially or at a non-intersecting angle to the shaft. Each slot holds a straight blade-like vane having a leading edge that contacts the cylinder wall. The vanes are biased against the cylinder wall by centrifugal force to create a sliding seal. The vanes slide in and out in each slot as the rotor is turned by contact with the cylinder wall because the rotor is eccentrically mounted in the cylinder. Rotation of the rotor pulls air from an inlet port in the housing through the cylinder and out an outlet port. Because the rotor is eccentrically mounted, air chambers defined between consecutive vanes will vary in size as the rotor is turned. This creates areas of expansion or compression within the cylinder, the inlet being in communication with an area of net expansion and the outlet port being in communication with an area of net compression.

Some rotary vane pumps include three (or more) ports communicating with the interior of the pump cylinder. For example, U.S. Pat. No. 2,639,855 discloses a rotary pump having three ports extending through the wall of the pump cylinder. The ports are described as an inlet port, an outlet and an intermediate port which is valve controlled to allow the pump to operate under various conditions. In one form, when the pump is operated with the control valve set to at least partially open the intermediate port air can enter the pump chamber through the inlet port as well as through the intermediate port. This increases the volume of air in the chambers between the vanes and thus the volume and pressure of air expelled from the pump. This technique is beneficial in that flow can be increased without changing the displacement of the pump (i.e., the diameter or length of the cylinder bore).

One problem with this early construction is that it requires separate supply lines and connections for each inlet port, thus increasing costs and making the pump less desirable for single source applications. Another problem with this construction is that it may be unsuitably noisy for certain applications given that no sound damping is provided. And, because the ports are formed separately through the exterior of the cylinder, any such sound damping components would have to be provided for each port, which again increases costs.

U.S. Pat. Nos. 4,544,337 and 4,580,949 disclose rotary vane pumps with two or more suction ports. Despite disclosing several embodiments in which the additional port(s) extend through the cylinder wall directly, these references also teach locating an extra inlet port in an end plate mounted to the pump cylinder so that the inlet port is internally located between the pump cylinder and an end case. At least in the construction of the U.S. Pat. No. 4,544,337 patent, this could permit a single intake port to the pump housing to feed supply air to both suction ports. However, these references also fail to provide sound dampening and thus are likely too noisy for certain applications. Moreover, these patents pertain to a specific industry (refrigeration), and in the U.S. Pat. No. 4,544,337 patent, the additional port is disclosed as providing a suction loss such that vane chamber pressure drops lower than supply source pressure of the refrigerant, thus retarding the flow rather than increasing it.

Accordingly, an improved rotary vane pump is needed in the art that provides increased flow characteristics with improved sound dampening.

SUMMARY OF THE INVENTION

The present invention provides a rotary vane pump having a housing with an open end and a closed end defining a pump cylinder therebetween. The closed end has a sound chamber and defines a primary inlet port, a secondary inlet port spaced from the primary inlet port and an outlet port all in communication with an interior of the cylinder, the primary and secondary inlet ports receiving air routed through the sound chamber. A drive motor is mounted to the open end of the housing and has a rotatable drive shaft eccentrically disposed in the cylinder to mount a rotor having multiple vane grooves opening at a circumference of the rotor, each groove slidably receiving a vane having a leading edge contacting an inner diameter of the cylinder.

In one preferred form, the sound chamber has a plurality of partitions defining a plurality of cavities. The partitions have passageways for communication of air from an intake port to the primary and secondary inlet ports. Air enters the secondary inlet port after passing through at least two of the plurality of cavities, one of which contains a sound filter and is located adjacent the intake port. Preferably, only this cavity feeds air to the primary inlet port.

In another preferred form, the closed end of the housing includes a separate end plate and end case. The end plate contains the outlet port and the primary and secondary inlet ports. The end case is mounted to the end plate and defines the sound chamber.

One preferred embodiment of the rotary vane pump of the present invention includes an open ended pump cylinder mounting a drive motor at one end and an end plate and sound chamber at the other end. The cylinder contains a rotor mounted to an eccentric drive shaft and having vane grooves receiving slidable vanes contacting an inner diameter of the cylinder. The end plate has an outlet port and primary and secondary inlet ports in communication with the cylinder interior. The sound chamber has an intake port and an exhaust port in communication with the respective outlet and primary and secondary inlet ports of the end plate. The sound chamber is partitioned to define a number of internal cavities through which the air must pass to reach the secondary inlet port.

The use of a third, or secondary inlet, port provides a rotary vane pump having several advantages over the prior art. The inventors have determined that the use of a separate additional inlet port, rather than simply enlarging a single inlet port, increases the flow capacity of the pump. The size and location of the secondary inlet port is varied to tune the flow of the pump. For example, moving the secondary inlet port closer to the inlet and (or alternatively) making it larger will increase flow and vice versa. The secondary inlet has also been found to improve pump efficiency and prolong life. Moreover, the secondary inlet port, particularly when internal to a sound chamber, has significant noise reduction benefits, which can be extremely important for certain applications. The sound benefits are realized in two ways. The improvements in flow volume provided by the secondary inlet port means that it is not necessary to increase the displacement of the pump (otherwise required to achieve the same flow volume), which would increase size due to the larger cylinder bore and/or length. Further sound dampening is achieved by including a secondary inlet port that is completely internal to the housing and receives air routed through a sound chamber. The pump of the present invention can have additional cost benefits in that both of the primary and secondary inlet ports can be fed air from the same supply line and coupler fitting and passed through the same inlet filter, thus eliminating the need for redundant components.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
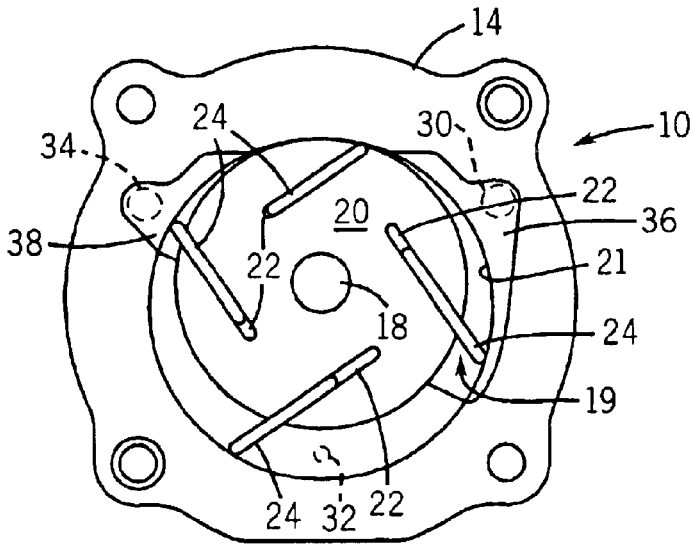
FIG. 1 is an end view of a rotary vane pump having primary and secondary inlet ports according to the present invention, shown with an end plate removed to reveal a four vane rotor inside a pump cylinder.
Figure 2:
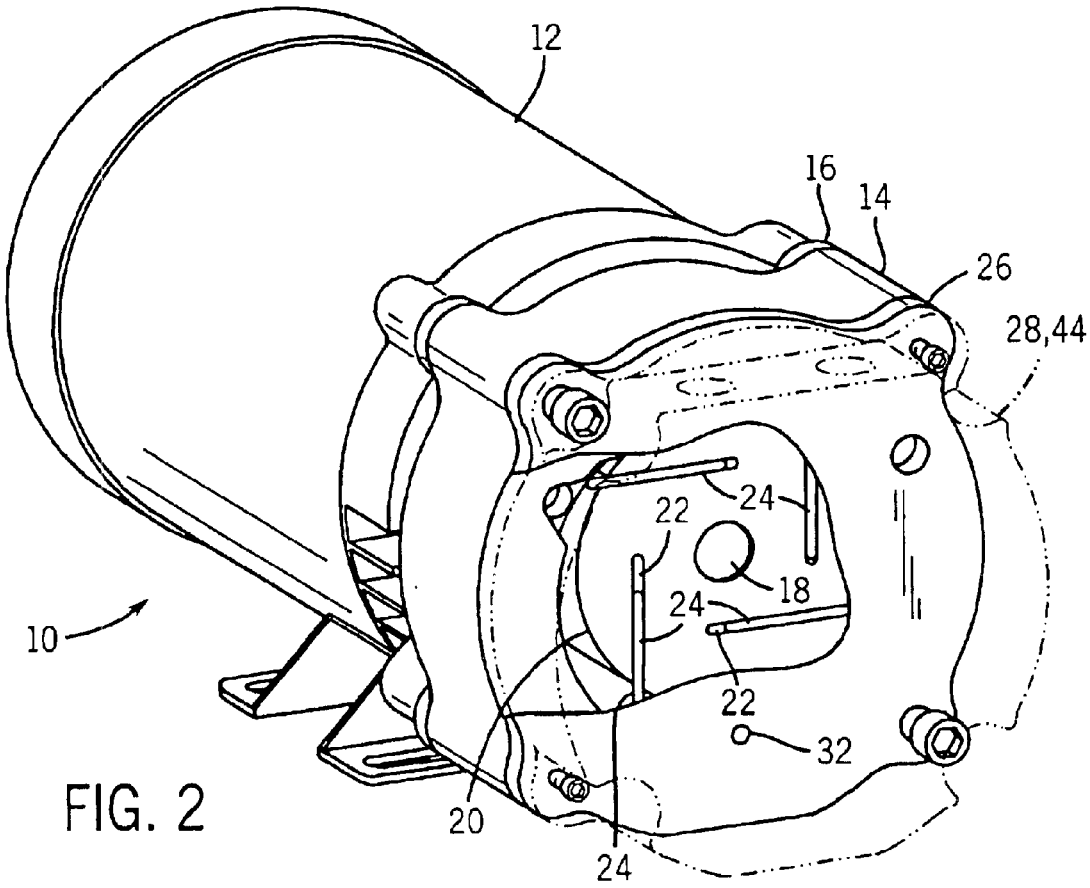
FIG. 2 is a perspective view of a preferred pump assembly with a an end case having a sound reducing chamber shown in phantom.
Figures 3, 4:
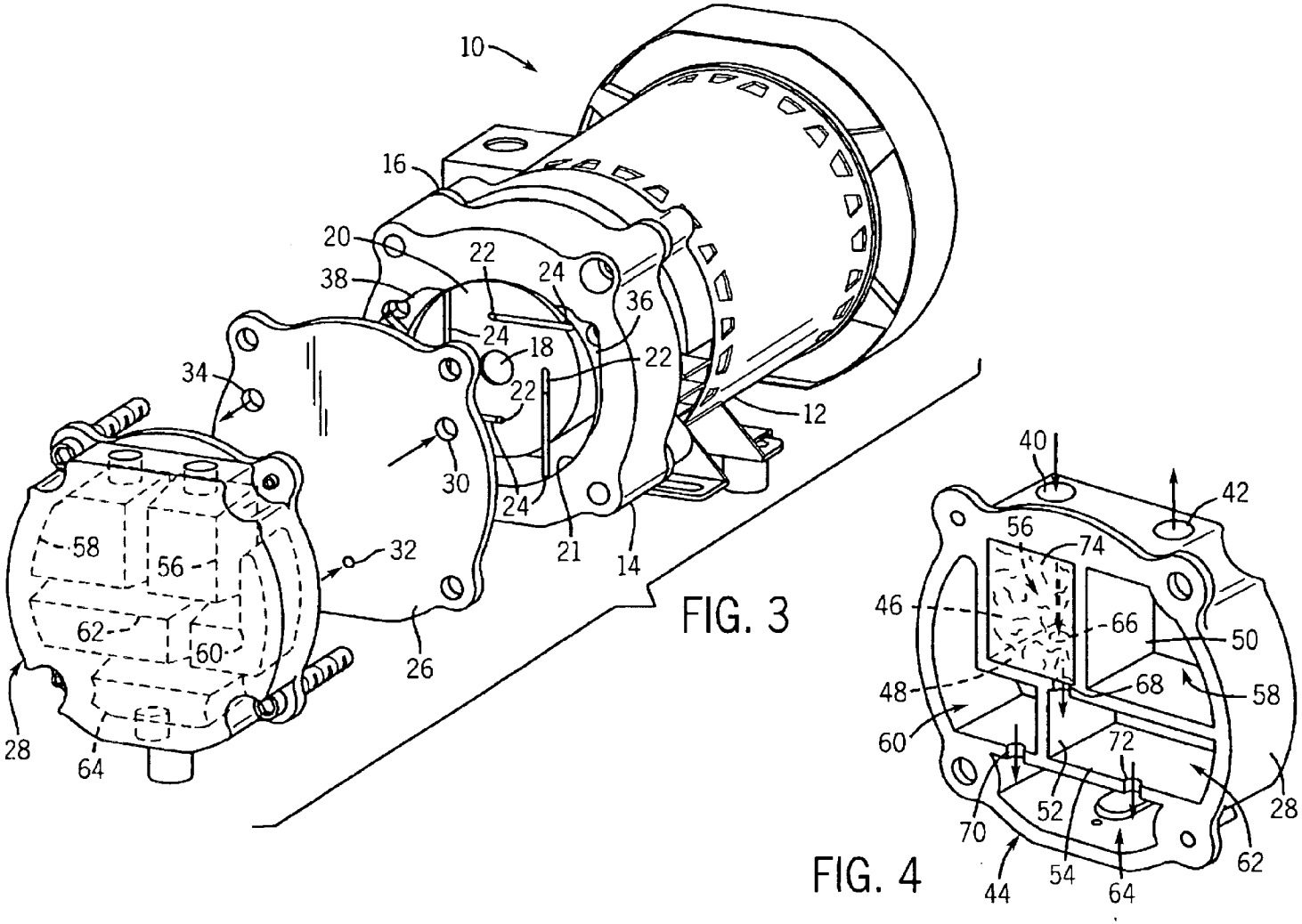
FIG. 3 is an exploded perspective view thereof.
FIG. 4 is a rear perspective view of the end case.

A preferred version of the pump of the present invention will now be described in detail with reference to the figures. Referring to FIGS. 2 and 3, the rotary vane pump 10 includes a suitable drive motor 12 mounted to an open ended cylinder housing or pump cylinder 14 with a first end plate 16 mounted therebetween. The drive motor 12 rotates a drive shaft 18 extending through the first end plate 16 and into the chamber 19 of the pump cylinder 14 so that it is parallel to but radially spaced from a centerline of the pump cylinder 14 so as to be eccentric thereto. The shaft 18 mounts in any suitable manner a cylindrical rotor 20 free to rotate inside the pump cylinder 14 with the shaft 18. perpendicular to a radius line extending through the center of the rotor 20. Each vane groove 22 holds a separate vane 24 extending axially slightly less than the length of the cylinder chamber 19. The vane grooves 22 are sized slightly larger than the thickness of the vanes 24 so that the vanes are free to slide back and forth in the vane grooves 22 such that a leading edge of each vane 24 contacts the inner wall of the cylinder chamber 19. The leading edges of the vanes 24 are tapered and biased in contact with the chamber wall 21 by centrifugal force generated by rotation of the rotor 20 so as to create a seal therebetween. Since the rotor 20 is eccentrically mounted in the cylinder chamber 19, the spacing between the chamber wall 21 and the periphery of the rotor 20 varies from 0 to 360 degrees (see FIG. 1). Contact with the chamber wall 21 will push the vanes 24 toward the inner end of the vane grooves 22 as needed.

A second end plate 26 mounts to the end of the pump cylinder 14 opposite the first end plate 16 between the pump cylinder 14 and an end case 28. End plate 26 has three axially extending ports, namely, primary inlet port 30, secondary inlet port 32 and outlet port 34. The primary inlet port 30 and the outlet port 34 align with respective inlet 36 and outlet 38 clocking at an upper part of the face of the pump cylinder 14 through which they are in communication with the cylinder chamber 19.

The secondary inlet port 32 is located within an arc swept between the primary inlet port 30 and the outlet port 34 in communication with a bottom region of the cylinder chamber 19 having the largest spacing between the rotor 20 and the chamber wall 21. One preferred location is the 6 o'clock position when viewing the pump 10 as in FIG. 1. This location (or near to it) is desirable because it is at a transition area between expansion and compression, realizing net expansion. This location can vary somewhat to alter the flow characteristics of the pump 10. Moving the secondary inlet port 32 toward an area of primary expansion closer to the inlet clocking 36 will increase flow and moving it to an area of primary compression closer to the outlet clocking 38 will decrease flow. Additionally, preferably the secondary inlet port 32 has a smaller diameter than both the primary inlet port 30 and the outlet port 34. However, its size can also be varied to tune the pump 10 as desired. Enlarging the secondary inlet port 32 will increase flow, while narrowing it will decrease flow.

Referring to FIGS. 3 and 4, the end case 28 closes off the end of the pump cylinder 14 to which the second end plate 26 is mounted so that its ports are internal to the pump 10. The end case 28 also defines intake 40 and exhaust 42 ports, to which suitable fittings (not shown) are connected, and a sound reducing chamber 44. The sound chamber 44 is formed by five partitions 46–54 which in combination with the exterior walls of the end case 28 define five cavities 56–64, as shown in FIG. 4. A seal or gasket is disposed between the end case 28 and the end plate 26 to isolate the incoming and exiting air streams. Air communication is provided from the intake port 40 to the primary inlet port 30 through cavity 56 and cavity 58 provides air communication between the exhaust port 42 and the outlet port 34. A hole 66 and a notch 68 in horizontal partition 48 provide communication between cavity 56 and respective cavities 60 and 62. Cavities 60 and 62 are each in communication with cavity 64 through notches 70 and 72, respectively, in horizontal partition 54 (separated by vertical partition 52). Thus, air is routed from the intake port 40 into cavity 56, through hole 66 into cavity 60 and through notch 68 into cavity 62, then from cavity 60 through notch 70 and from cavity 62 through notch 72 to cavity 64 and then to the cylinder chamber 19 through the secondary inlet port 32 (as shown by the arrows in FIGS. 3 and 4). An intake air and sound filter 74 (preferably a foam material) is disposed in cavity 56 such that both the primary 30 and secondary 32 inlet ports are filtered by a single filter.

In operation, air is drawn in though the intake port 40 and simultaneously passed by the filter. Air leaving the filter splits so that air can pass directly from cavity 56 to the primary inlet port 30 while the remaining air winds through the other cavities of the sound chamber 44 before reaching the secondary inlet port 32. Air from the primary inlet port 30 will pass into the inlet clocking 36 which air from the secondary inlet port 32 enters a bottom section of the cylinder chamber 19. In the case of a four vane pump with the secondary inlet port located as shown, one vane 22 will always be disposed between the primary 30 and secondary 32 inlet ports such that they open at different vane chambers defined by consecutive vanes. Note, however, that this is not necessary, and likely will vary when more or less vanes are used. In any event, the pump will take in a certain volume of air in a vane chamber from the primary inlet port 30. As the rotor turns so that the vane chamber travels from the inlet 36 to the outlet 38 clocking, it begins by expanding and then at some point near the bottom of the cylinder chamber 19 it begins to transition to compression. As mentioned, the secondary inlet port 32 is located in this region at an area of net expansion such that the vane chamber can take in additional air. As the vane chamber continues from the secondary inlet port 32 to the outlet clocking 38 it compresses the air and forces the pressurized air through the outlet port 34 and out the exhaust port 42. The cycle continues like this for every revolution of the rotor 20 and for each vane chamber.

This arrangement is particularly designed for receiving air through the single intake from a single source and for operating as a single use in which either the intake port or the exhaust port is coupled to ambient air. When the intake is open to ambient, the pump provides pressurized air through the exhaust port and when the exhaust port is open to ambient, the pump draws a vacuum through the intake port. It should be noted of course that the pump is capable of dual use operation in which each of the intake and exhaust ports are coupled to a load to simultaneously pull a vacuum and provide pressure.

Accordingly, the present invention provides a rotary vane pump with increased flow capacity, which can be tuned by varying the size and location of the secondary inlet port. Air to both the primary and secondary inlet ports enters through a single intake port and is routed through a sound chamber having a single air filter, thus providing cost and sound reduction benefits. The sound benefits are realized by the internal sound chamber as well as because the secondary inlet port obviated the need to increase the cylinder bore and/or length to gain flow. Cost benefits are achieved by reducing or eliminating redundant components.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A rotary vane pump, comprising:

a housing having an open end and a closed end defining a pump cylinder therebetween, the closed end having a sound chamber and defining a primary inlet port, a secondary inlet port and an outlet port, wherein the outlet port is in communication with an area of compression in the pump cylinder, the primary inlet port is in communication with an area of expansion in the pump cylinder and, the secondary inlet port is in communication with an area of transition in the pump cylinder between the compression and expansion areas and having net expansion, and wherein the primary and secondary inlet ports each independently communicate media routed through the sound chamber to the associated expansion and transition areas;

a drive motor mounted to the open end of the housing and having a rotatable drive shaft eccentrically disposed in the cylinder;

a rotor mounted to the drive shaft and having a plurality of vane grooves opening at a circumference of the rotor; and a plurality of vanes slidable within the vane grooves and having a leading edge contacting an inner diameter of the cylinder.

2. The pump of claim 1, wherein the closed end of the housing includes a separate end plate containing the primary and secondary inlet ports and the outlet port and a separate end case mounted to the end plate and defining the sound chamber.

3. The pump of claim 1, wherein the secondary inlet port is located in a vane chamber defined by a leading vane and a trailing vane, wherein for at least part of the time that the vane chamber passes the secondary inlet port the leading vane is moving inward and the trailing vane is moving outward.

4. The pump of claim 1, wherein the sound chamber has a plurality of partitions defining a plurality of cavities, the partitions having passageways for communication of air from an intake port to the primary and secondary inlet ports.

5. The pump of claim 4, wherein air enters the secondary inlet port after passing through at least two of the plurality of cavities.

6. The pump of claim 5, wherein one of the at least two of the plurality of cavities contains a sound filter.

7. The pump of claim 6, wherein the cavity containing the sound filter is located adjacent the intake port.

8. The pump of claim 7, wherein the primary inlet port receives air passing only through the sound filter containing cavity.

9. A rotary vane pump, comprising:

an open ended pump cylinder;

a drive motor mounted to one end of the pump cylinder and having a rotatable drive shaft eccentrically disposed in the cylinder;

a rotor mounted to the drive shaft and having a plurality of vane grooves opening at a circumference of the rotor;

a plurality of vanes slidable within the vane grooves and having a leading edge contacting an inner diameter of the cylinder;

an end plate mounted to an end of the pump cylinder opposite the drive motor containing an outlet port in communication with a compression area in the cylinder, a primary inlet port in communication with an expansion area in the cylinder, and a secondary inlet port in communication with a net expansion transition area in the cylinder between the compression and expansion; and a sound chamber mounted to the end plate and having an intake port and an exhaust port, wherein the sound chamber is partitioned to define a number of internal cavities and wherein the exhaust port is in communication with the outlet port of the end plate and the intake port is in communication with the primary inlet port and the secondary inlet port of the end plate, wherein air must pass through at least two of the internal cavities to pass from the intake port to the secondary inlet port.

10. The pump of claim 9, wherein the secondary inlet port is located in a vane chamber defined by a leading vane and a trailing vane, wherein for at least part of the time that vane chamber passes the secondary inlet port the leading vane is moving inward and the trailing vane is moving outward.

* * * * *

UNITED STATES PATENT AND TRADEMARK OFFICE

CERTIFICATE OF CORRECTION

PATENT NO. : 6,790,019 B1
DATED : September 14, 2004
INVENTOR(S) : Ronald R. Hinchey, Jr.

It is certified that error appears in the above-identified patent and that said Letters Patent is hereby corrected as shown below:

Column 3,
Line 55, "18. perpendicular" should be
-- 18.
The rotor 20 includes multiple (four in this case) axial vane grooves 22 spaced at equal angles around the rotor 20. The vane grooves 22 open at the outer circumference of the rotor 20 and each extends along a line perpendicular --

Signed and Sealed this

Nineteenth Day of April, 2005

JON W. DUDAS
*Director of the United States Patent and Trademark Office*